US006504559B1

(12) United States Patent
Newton et al.

(10) Patent No.: US 6,504,559 B1
(45) Date of Patent: Jan. 7, 2003

(54) DIGITAL THERMAL PRINTING PROCESS

(76) Inventors: Gerald W. Newton, 2929 W. 66th St., Tulsa, OK (US) 74132; Vincent J. Cahill, 11458 Country Circle, Waynesboro, PA (US) 17268

( * ) Notice: Subject to any disclaimer, the term of this patent is extended or adjusted under 35 U.S.C. 154(b) by 0 days.

(21) Appl. No.: 09/153,090

(22) Filed: Sep. 14, 1998

(51) Int. Cl.[7] ..... B41J 2/315
(52) U.S. Cl. ..... 347/171
(58) Field of Search ..... 427/152, 218; 399/333; 106/31.32; 347/171, 218

(56) References Cited

U.S. PATENT DOCUMENTS

| | | | | | |
|---|---|---|---|---|---|
| 4,137,447 | A | | 1/1979 | Boaz | |
| 4,292,104 | A | | 9/1981 | Heimbach et al. | |
| 4,445,432 | A | | 5/1984 | Ford, Jr. et al. | |
| 4,744,685 | A | | 5/1988 | Mecke et al. | |
| 5,294,277 | A | | 3/1994 | Obata | |
| 5,308,737 | A | | 5/1994 | Bills et al. | |
| 5,391,247 | A | | 2/1995 | Kamen et al. | |
| 5,453,766 | A | * | 9/1995 | Feytens et al. | 347/224 |
| 5,486,857 | A | * | 1/1996 | Smith et al. | 347/224 |
| 5,542,768 | A | | 8/1996 | Rother et al. | |
| 5,656,336 | A | | 8/1997 | Kamen et al. | |
| 5,665,472 | A | | 9/1997 | Tanaka et al. | |
| 5,684,515 | A | | 11/1997 | Ho | |
| 5,693,395 | A | | 12/1997 | Wine | |
| 5,708,047 | A | | 1/1998 | Kamen et al. | |
| 5,741,754 | A | | 4/1998 | Imoto et al. | |
| 5,774,926 | A | * | 7/1998 | Jacoby | 15/250.001 |
| 5,776,280 | A | | 7/1998 | Puckett et al. | |
| 5,830,529 | A | * | 11/1998 | Ross | 427/152 |
| 5,918,098 | A | * | 6/1999 | Van Bennekom | 399/333 |
| 5,922,115 | A | * | 7/1999 | Sano et al. | 106/31.32 |
| 5,948,471 | A | * | 9/1999 | Zimmer | 427/218 |
| 5,973,715 | A | * | 10/1999 | Ghosh et al. | 347/171 |
| 6,025,860 | A | * | 2/2000 | Rosenfelf et al. | 347/171 |
| 6,313,858 | B1 | * | 11/2001 | Kyogoku et al. | 347/215 |

* cited by examiner

*Primary Examiner*—John Hilten
*Assistant Examiner*—K. Feggins
(74) *Attorney, Agent, or Firm*—Fellers, Snider, Blankenship, Bailey & Tippens, P.C.

(57) ABSTRACT

A method for applying an image onto a substrate using a digital thermal transfer printing process. The process is particularly suitable for applying a ceramic ink to a substrate which is then fired to completion. The process includes transferring and/or storing the image digitally; transferring the stored image to a digital thermal transfer printer and then applying the image to the desired substrate such that the ink fuses to the substrate. An intermediate step may also be included of applying the image to a transfer member from which the image is transferred to the substrate. Such transfer members include image receiving pads or belts or decals. The digital thermal transfer printer may be configured to replace existing printing devices.

26 Claims, 5 Drawing Sheets

DIGITAL THERMAL PRINTING PROCESS

BACKGROUND OF THE INVENTION

1. Field of the Invention

This invention relates generally to processes for applying a digital image to a substrate and more particularly to processes for applying an image to a rigid or three-dimensional substrate or object, either directly or indirectly, using digital imaging processes.

2. Background of the Invention

Decorative and other Images are applied to rigid or three dimensional substrates, such as plates, cups, tiles, and various forms of glassware by employing screen printing processes. This is made possible by the versatility of the screen printing process which can be used to print on any material surface having almost any shape since the pigment(s) passes through a printing screen onto the substrate rather than requiring contact between a printing plate and the substrate. In addition to its use on rigid or three dimensional objects, screen printing is used for printing ceramic inks onto a substrate which is then fired to fuse the ink and the substrate. This is done most commonly either by direct printing a decorative image on ceramic or glass surfaces or indirect decorating through the use of ceramic decals which are then applied to the substrate. Such substrates include tile, flat glass, hollow-ware, ceramic sheets and objects, and porcelain, including porcelain enameled steel and aluminum. Many of these application processes require the controlled deposition of precise thicknesses and relatively large particles to meet the parameters of diverse decorating and marking applications.

Since ceramic inks include pigment and glass frit (as well as other materials), it is necessary for the pigment and frit particles to be capable of passing through the print mechanism (screen) and onto the substrate. Screen printing, however, is limited by the fact that it requires substantial set-up and corresponding clean-up time feasible only for long product runs using the same image. Economies of set-up/clean-up produce large inventories of a limited variety of printed products. The present popularity, or necessity of just-in-time inventories render screen printing methods unattractive.

As an alternative to screen printing or other similar analog printing methods, much attention has recently been directed to digital printing methods first developed mainly for printing on paper. Storing and printing a digital image allows the flexibility of changing, customizing, or altering the image being printed thereby avoiding the set-up/clean-up time associated with screen printing.

With regard to digital printing, much attention has been directed to laser and ink jet technologies due to their ability to produce high resolution images at high speed. These methods, however, are very costly and not proven to provide the most durable image. Further, many industrial applications do not require high resolution but do require reduced set-up time or the flexibility of shorter production runs which digital methods can cost effectively supply.

Electrophotographic technologies are not easily applied directly to rigid or three dimensional substrates, nor do they employ ceramic inks (frits). Additional problems have been encountered when printing with ceramic inks using ink jet technologies due to the fact that the size of the frit particles is important in producing a vivid image after firing. Large particles which are necessary for some colors cannot pass through an ink jet necessary for high resolution. A need, therefore, exists for a digital print process allowing immediate changes in image design and short product runs capable of printing on rigid or three dimensional substrates and for use with ceramic inks. A particular need exists for such a digital print process for applications where high print resolution is not required.

Presently, glassware such as automotive or appliance glass is screen printed using ceramic or metallic inks. The perimeter edges of present automotive glass are printed with ceramic ink to hide and protect the adhesive used to secure the glass in place. Ceramic inks including metallic powders are printed on tempered glass and then fired to form conduct circuits electric heater plates for rear window defroster applications and antennae for signal reception and transmission. Heater plates are printed so as to form an electrical circuit providing heat from current flow through the printed lines. Here, control of the ink lay down is an important factor for proper current flow. Appliance glass is similarly printed to form decorative border patterns. Ceramic ink is used for its durability and because it is unaffected by high temperatures. The inventory and set-up problems associated with screen printing is present in these printing applications as well. A need also exists for a digital print process capable printing on rigid substrates, such as glassware, flat glass, hollow ware, ceramic sheets and objects, tile, and porcelain, including porcelain enameled steel and aluminum.

SUMMARY OF THE INVENTION

The present invention is, generally, a process for fixing an image onto a substrate using a digital thermal transfer printing process. Specifically, the present process is useful for applying a ceramic ink to a substrate(s) which is then cured and/or fired to completion. The substrate could be a rigid sheet of material such as flat glass, ceramic sheets or tile; or a three dimensional object such as ceramic objects, hollow ware, and porcelain, including porcelain enameled steel or aluminum. The present process may include an intermediate step of applying the image to a temporary member and then transferring the image to the substrate. In this alternate method, inks, other than ceramic inks, may be applied to a rigid or the alternate substrate.

The process includes either direct image transfer from an image transmission device or storing the image digitally in a digital computer system or other suitable storage medium; transferring the transmitted or stored digital image to a digital thermal transfer printer wherein the printer includes a ribbon having ceramic ink thereon; transferring the image to the desired substrate via the digital thermal transfer printer; and firing out the substrate such that the ceramic ink fuses (thermochemically bonds) to the substrate.

Further, an image may be transferred to a rigid or three dimensional substrate using the present process through the inclusion of an intermediate step of applying the image to a transfer member, such as a silicone (or silicone impregnated rubber or polytetrafluoroethylene) pad, and then transferring the image from the temporary member to the substrate. Other transfer members include silicone group containing resin, silicone group containing rubber, fluorine containing resin, fluorine containing rubber or the like. However, usable therefore is any resin having a favorable transfer surface tension while possessing elasticity, and heat resistance to a satisfactory extent.

Other transfer methods include printing the image on a decal and then transferring the decal to the substrate. Here the decal could be stored for later transfer or the transfer step may even occur at a different location. This embodiment of the process is equally useful for inks other than ceramic inks wherein the firing step is unnecessary. In this alternate method, the ink may be dried (thermal, convection, induction, oxidation) or cured (photo or radiation activated) or bonded to the substrate.

The present invention can be an in-line process useful in manufacturing and industrial production lines or small shop environments wherever there is an application to print an image on a rigid or three dimensional substrate, and especially suitable for printing decorative images using ceramic inks. For example, a decorative image, such as a flower, may be printed on an object, such as a coffee mug or a ceramic tile, wherein the flower image is digitally stored on a digital computer system and then transferred to a digital thermal transfer printer including a ceramic ribbon therein at which point the flower image is printed onto the coffee mug or tile. The coffee mug or tile is then fired out to fuse (thermochemically bond) the flower image to the coffee mug or tile.

In this way, the present process eliminates the substantial down time associated with set up of analog printing methods, such as screen printing. Since this substantial down time is substantially reduced, if not eliminated, a smaller number of products (product run) become cost effective as are required for just-in-time inventory or where only a small number including a variety of different small numbers of products are necessary. Since this process includes digital data, storage of images can be held on digital storage media for just-in-time use as opposed to printing a large number of images (or products) for shelf storage awaiting use or sale.

Other particularly suitable applications for the present printing process include printing automotive and appliance glass as well as printing electronic circuits. In these applications where resolution, or multiple color, is not a critical factor but just-in-time inventory is, the thermal digital printing method of the present invention is particularly useful. However, thermal transfer printers of the present invention are capable of high resolution including high resolution application of colors and expanded gambit process color printing.

It is an object of the present invention to provide a process for affixing an image onto a substrate using a digital thermal transfer printing process.

It is a further object to provide a printing process as described above which substantially reduces or eliminates down time associated with changing the image. A still further object of the present invention is to provide a printing process as described above which allows for shorter product runs.

Other aspects, objects and the several advantages of this invention will become apparent from the following detailed description, drawings and appended claims.

DETAILED DESCRIPTION OF THE PREFERRED EMBODIMENT

The process of the present invention includes storing the desired decorative image digitally in a digital computer system or other suitable storage medium; transferring the stored digital image to a digital thermal transfer printer wherein the printer includes a ribbon having ceramic ink thereon; transferring the image to the desired substrate via the digital thermal transfer printer; and firing out the substrate such that the ceramic ink fuses (thermochemically bonds) to the substrate.

The present invention is an in-line process useful in manufacturing and industrial production lines or small shop environments wherever there is an application to print an image on a rigid or three dimensional substrate, and especially suitable for printing decorative images using ceramic inks.

Such ceramic inks are applied to the sheet or foil of a thermal transfer ribbon as a part of the transfer layer. Generally, the ceramic ink composition includes frit and particles such as pigments, dyes, colorant oxides, metallic powders, refractories, conductives, stains, and or micaceous powders dispersed in a binding medium. The binding medium is thermally sensitive and may include wax, resin, oil, solvent, or compounds or mixtures having water miscible, radiation curable, and thermoplastic properties.

Figure 1:
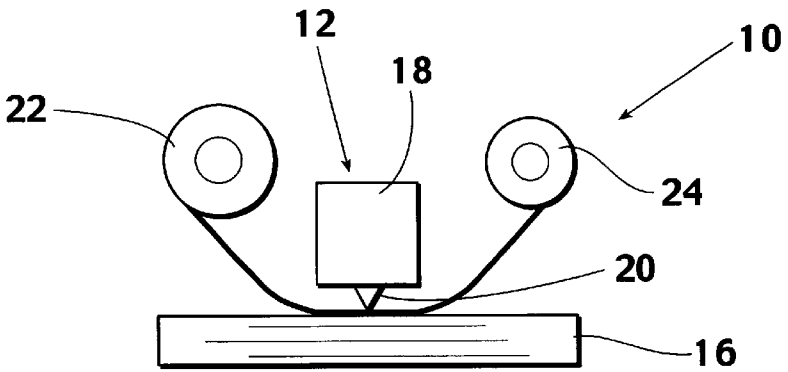
FIG. 1 is a diagrammatical side view of a thermal digital print head and ribbon of the present invention applying an image to a flat, rigid substrate.

Referring to FIG. 1, a diagrammatical side view of a basic thermal digital print system 10 is shown. Thermal digital print system 10 includes thermal print head 12, ribbon (or foil) 14, and substrate 16. Print head 12 printing elements, collectively 20, to which current is selectively applied to melt the transfer layer of ribbon 14 to selectively impart thermal transfer ink to substrate 16.

Ribbon 14 passes under print head 12 between printing elements 20 and substrate 16 from a supply spool 22 to a take-up spool 24. Ribbon 14 includes thermal transfer ink thereon. Ribbon 14 may be a thermal transfer ribbon known in the industry and including a foil support or carrier, such as paper or synthetic resin, a fusible color-transfer layer the form of a wax-bonded dyestuff, pigment, or ink. In some ribbon construction, intervening layers of selected materials are applied between the substrate and the color transfer layer in order to facilitate transfer of the image with the desired degree of resolution and definition.

In system 10, printing is effected by the selective application of ink as contained on ribbon 14 onto substrate 16 by selectively inducing current to the individual heating elements causing them to become heated. The application of this heat to ribbon 14 causes the ink affixed to the support or carrier of ribbon 14 to release and bond to the substrate. This selective introduction of current to the print elements controls the pattern of ink applied to the substrate. This selectively controlled pattern of ink forms the desired decorative image applied to substrate 16.

Thermal transfer print system 10, of FIG. 1, is a direct print system wherein the image is applied to substrate 16 through direct contact between printing elements 20 and substrate 16 through ribbon 14. Although substrate 16 is depicted as a rigid sheet, such as flat glass (automotive or appliance), the direct print system can be used to print on three dimensional objects, such as hollow-ware, ceramic ware, or porcelain ware.

Figure 2:
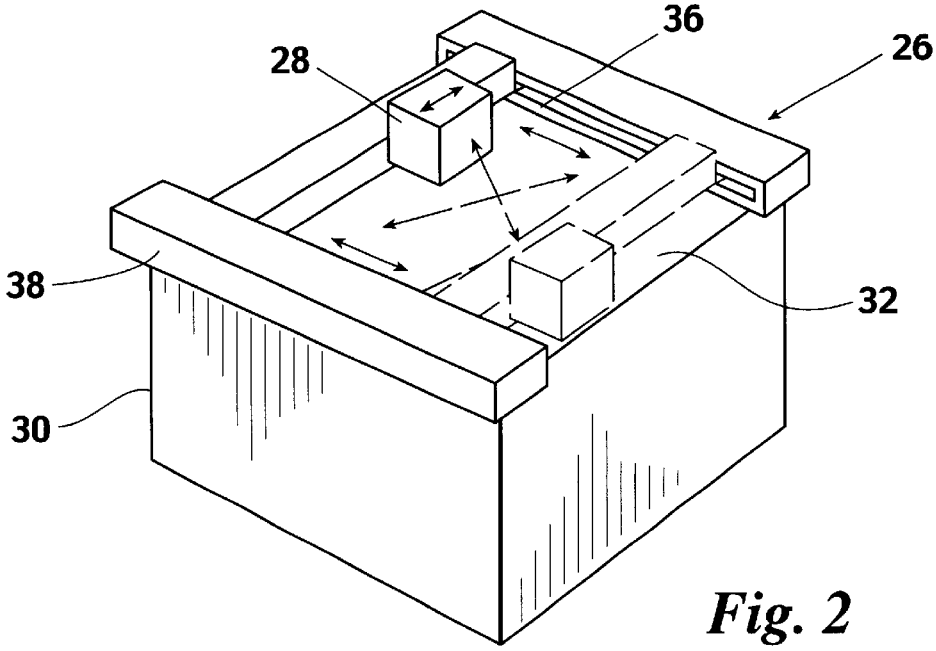
FIG. 2 is a representation of the thermal digital print head and ribbon installed in an x, y, z plotter printer where the substrate is fixed and the print head moves in relation thereto.

In order to accomplish the direct print process of the present invention, digital print system 10 may be configured to replace known digital print systems so as to print on rigid or three dimensional substrates. Referring next to FIG. 2, a thermal transfer digital print head 28 is shown installed in an x,y,z plotter printer. Thermal transfer print head 28 is identical to thermal transfer print system 10, of FIG. 1.

In the direct thermal transfer printer 76 of FIG. 2, a substrate base 30 supports a rigid substrate 32, such as appliance glass on which a digital image is printed. In this embodiment, substrate 32 is registered and secured in place, such as by a vacuum belt or foller stop sytem known in the art. With substrate 32 secured, print head 28 moves across the surface of the substrate 32 in relation thereto.

Print head 28 is affixed to a carrier arm 34 such that print head 28 is capable of traveling along the length of carrier arm 34 in the x axis. Support carrier arm 34 is capapble of reciprocating along the width of substrate base 30 within tracks 36 and 38. Movement of the print head 28 on the x axis and movement of carrier arm 34 in the y axis allows print head 28 access to the entire surface of substrate 32 (as shown in FIG. 2) for printing thereon. Print head 28, carrier arm 34 and track assemblies 36 and 38 are capable of raising a lowering with respect to substrate base 30 so as to accommodate substrates of various varying thicknesses.

Figure 3:
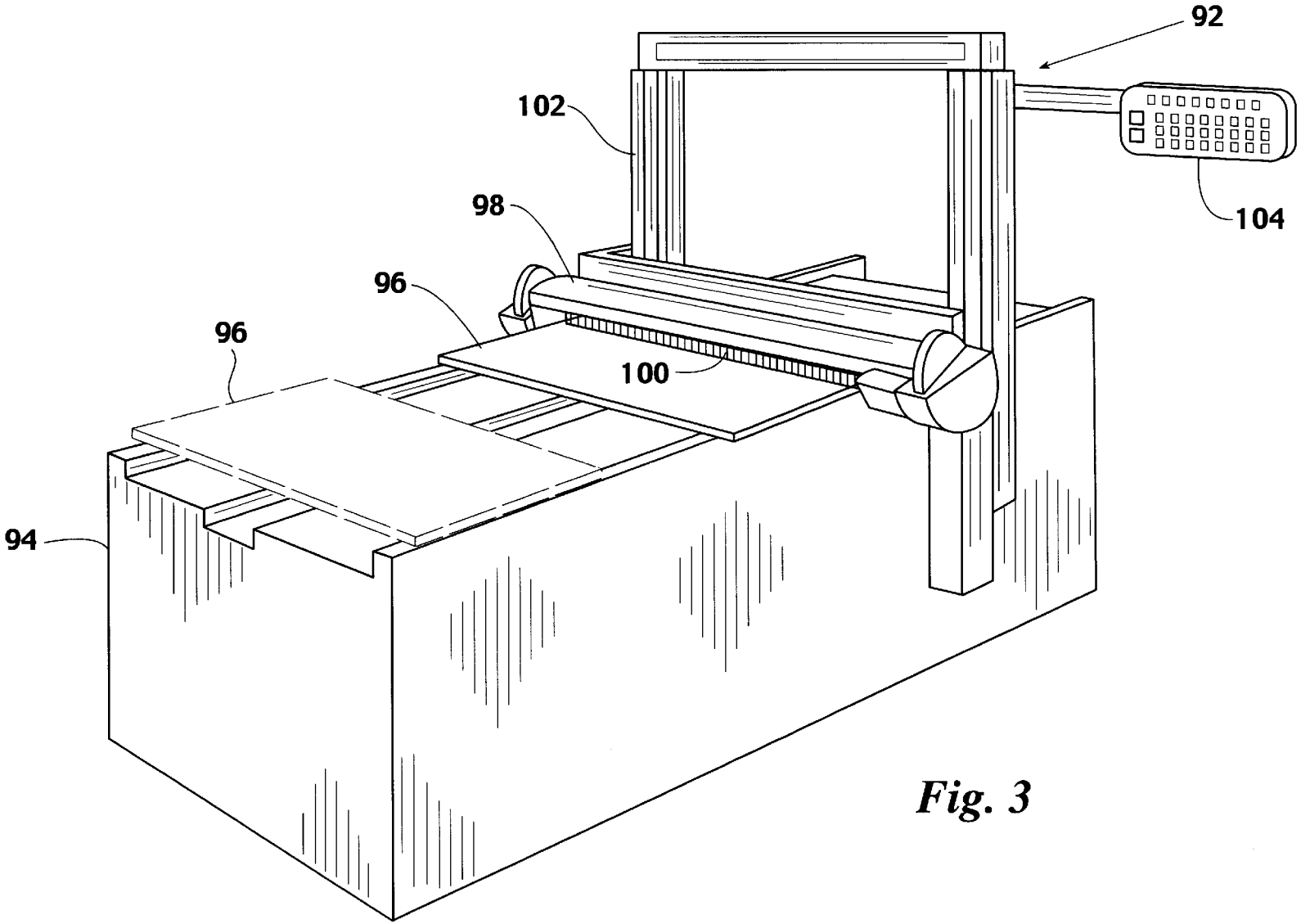
FIG. 3 is an isometric view representing a thermal transfer print head configured in a fixed array printer wherein the print head remains fixed and the substrate is conveyed thereunder.

Referring next to FIG. 3, an isometric view depicting a thermal transfer print head 98 configured in a fixed array printer 92. In this embodiment, Substrate 96 in fixed array printer 92 moves while print head 98 remains fixed. Thermal transfer print head 98 in fixed array printer 92 is the same width as rigid substrate 96 so as to effect printing across the entire surface of substrate 96. Print elements 100 apply a thermal transfer ink from a ribbon inserted between print elements 100 and substrate 96.

Fixed array printer 92 also includes substrate base 94, print head support frame 102 and control means 104. Substrate 96 is conveyed across substrate base 94.and may be a part of an in-line process where substrate 96 is conveyed to another station, such as a Lehr.

Print head support frame 102 provides means for raising thermal print head 98 to accommodate for substrates of various thicknesses. Substrate base 94, as well as thermal print head 98 is controlled via control means 104.

Figure 4:
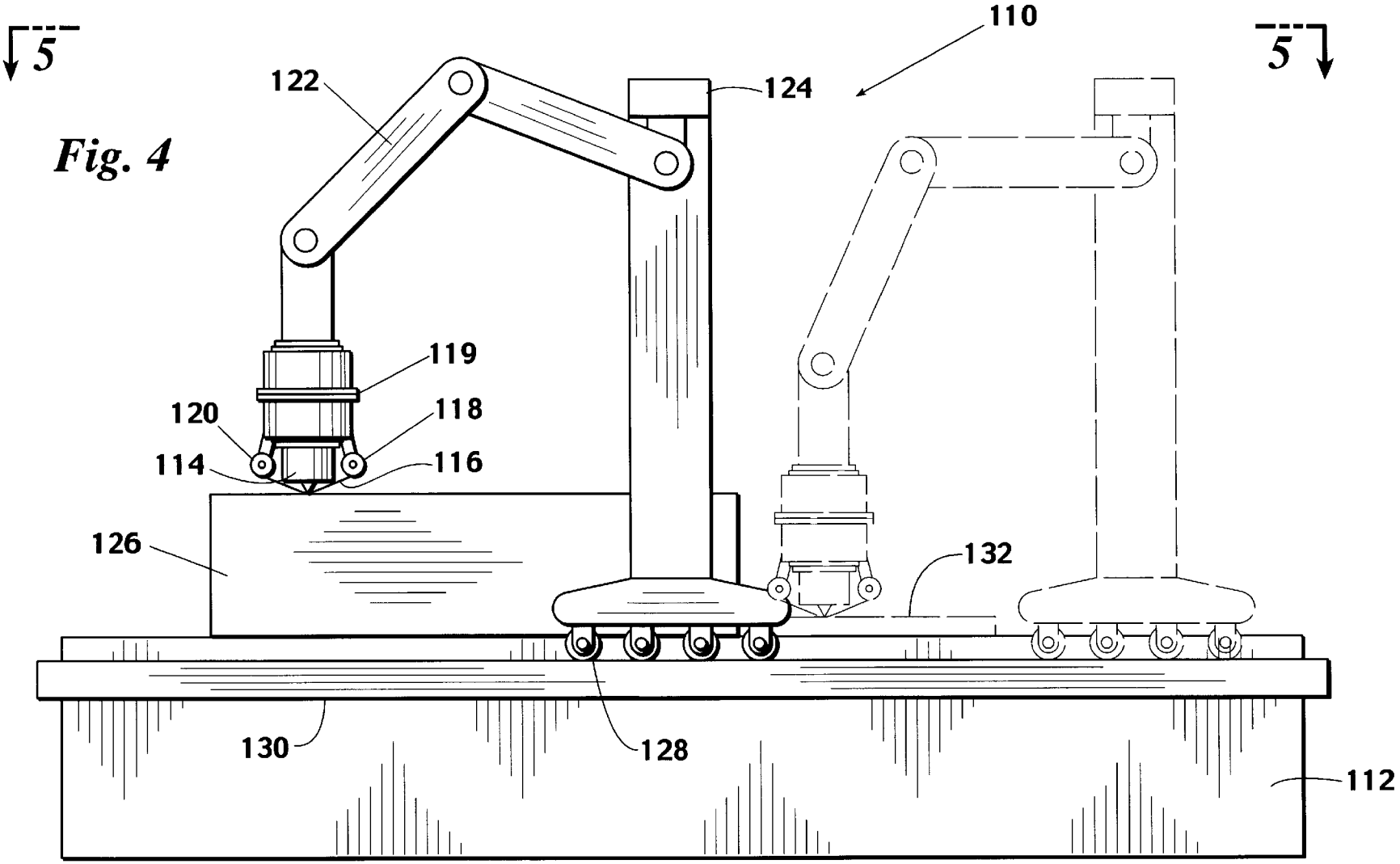
FIG. 4 is a side elevation view of a thermal transfer print head configured on an articulated arm wherein the substrate is fixed and the print head moves in relation thereto.

FIG. 4 is an elevation view of a thermal transfer print head 114 configured in an articulating arm printer 110. Thermal transfer print head 114 also includes a thermal transfer ribbon 116 including a meltable thermal transfer ink layer thereon. Ribbon or foil 116 travels from a supply spool 118 to a take-up spool 120 between the printing element of print head 114 and substrate 126. The printing element of print head 114 selectively melts the thermal transfer ink layer of ribbon 116 to impart an image on substrate 126.

A substrate carrier 112 conveys and registers substrate 126 into place. Substrate carrier 112 may operate as a stand-alone unit or as a part of an in-line process. Substrate carrier 112 includes a rail or track 130 to support frame 124 and also to provide a platform on which frame 124 may travel. Frame 124 extends vertically from substrate carrier 112, and supplies a support frame for arm 122.

Arm 122 is a robotic support which carries and positions thermal print head 114 over substrate 126. Arm 122 articulates so as to provide a wide range of movement for print head 114. Arm 122 articulates print head 114 toward and away from frame 124 and also raises and lowers print head 114 to compensate for substrates of various thicknesses. For example, arm 122 may position print head 114 over a thick rigid substrate 126 or over a much thinner substrate 132 (as shown in phantom). Frame 124 travels track 130 so as to provide an additional range of motion for print head 114. Frame 124 may travel on track 130 using wheels 128 as shown in FIG. 4 or any other suitable means.

Figure 5:
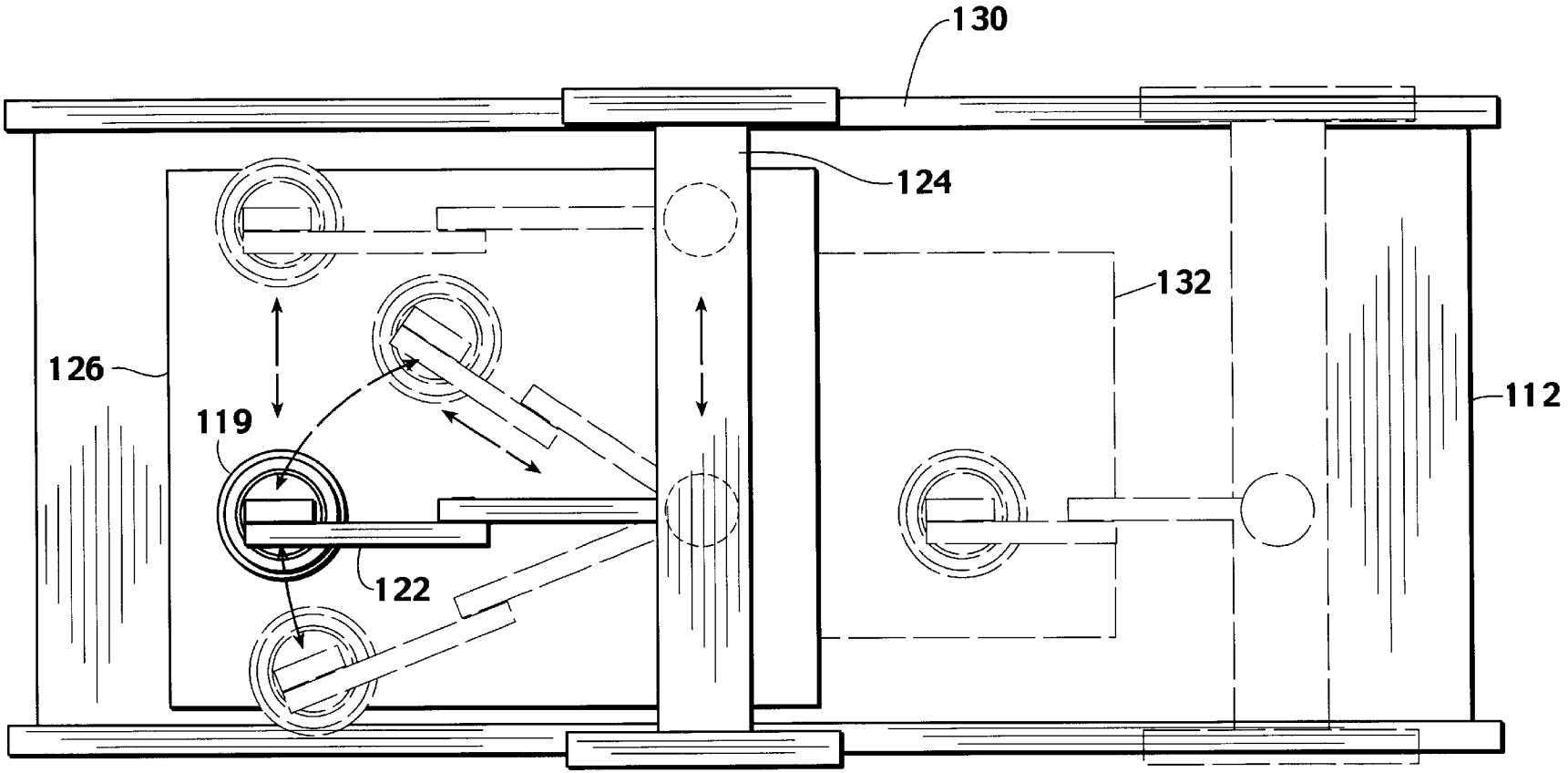
FIG. 5 is a top plan view of the printer of FIG. 6 depicting the range of motion of the thermal transfer print head on the articulated arm.

As can be seen in FIG. 5, a top plan view of articulated arm printer 110, articulated arm 122 may travel along the top length of frame 124 or may pivot about its axis in relation to frame 124 so as to provide an additional range of motion for print head 114.

Thermal transfer print head 114 is configured in a rotatable turret 119. Turret 119 is fixed to arm 122 and extends therefrom. Turret 119 allows print head 114 to print in any desired point or line on substrate 126. In this way a direct transfer thermal transfer print system is provided capable of unlimited motion across a fixed substrate.

An image may be transferred to a rigid or three dimensional substrate using the present process through the inclusion of an intermediate step of applying the image to a transfer member, such as a silicone (or silicone impregnated rubber or polytetrafluoroethylene) pad, belt, or drum and then transferring the image from the temporary member to the substrate. Other transfer members include silicone group containing resin, silicone group containing rubber, fluorine containing resin, fluorine containing rubber or the like. However, usable therefore is any resin having a favorable transfer surface tension while possessing elasticity, heat resistance and surface transfer energy to a satisfactory extent.

Other transfer methods include printing the image on a decal and then transferring the decal to the substrate. Here the decal could be stored for later transfer or the transfer step may even occur at a different location. This embodiment of the process is equally useful for inks other than ceramic inks wherein the firing step is unnecessary. In this alternate method, the ink may be dried (thermal, convection, induction, oxidation) or cured (photo or radiation activated) to the substrate.

Figure 6:
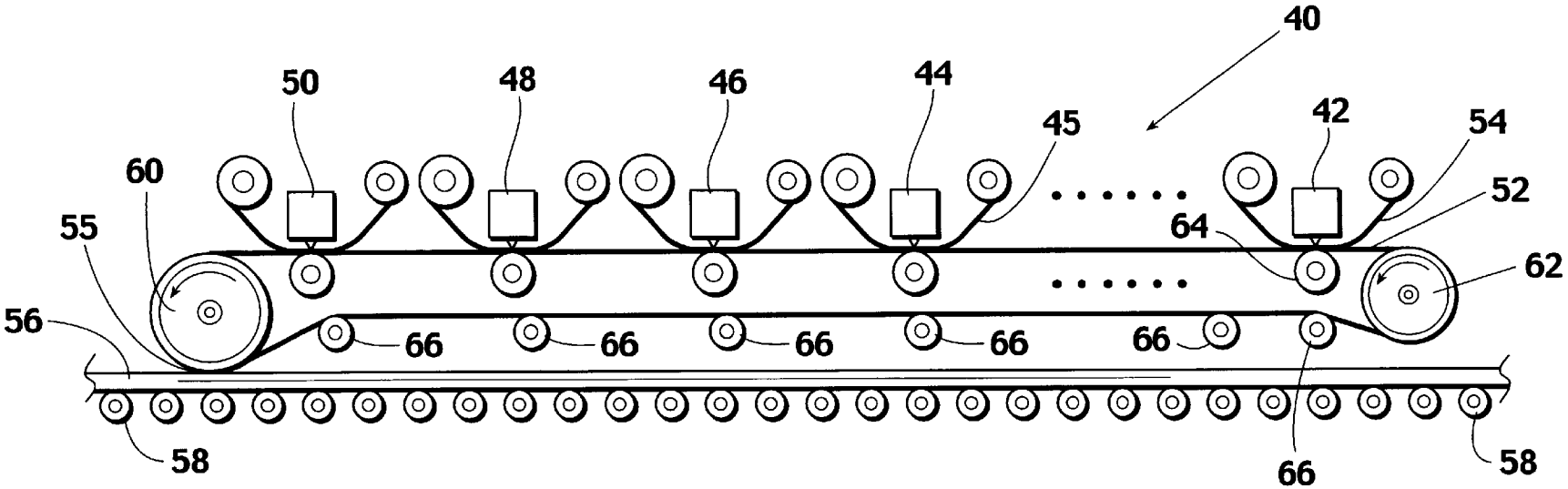
FIG. 6 is a schematic side view showing multiple thermal digital print heads printing an image onto a belt transfer member which is then imparting the image onto a flat rigid substrate conveyed thereunder.

FIG. 6 depicts the alternate embodiment of the present process wherein an image is applied to a substrate using an intermediate transfer member. Herein, a thermal transfer printing process 40 is shown. An image is applied to transfer member 52 by heating a meltable type thermal transfer ribbon 54 with thermal print head 42. The image applied to transfer member 52 is then transferred to substrate 56 a, physical contact between transfer member 52 and substrate 56 at contact point 55.

Thermal transfer printing process 40 is particularly suited for in-line production processes where substrate 56 is conveyed and registered in place so as to properly contact transfer member 52. Substrate 56 may be conveyed by any suitable means such as a series of rollers, collectively 58 (as shown in FIG. 6) or a vacuum belt.

In thermal transfer process 40, transfer member 52 is a belt design having a width of the size of the image. Transfer belt 52 is tensioned around wheels 60 and 62 and rotates continuously there around. Wheel 60 provides pressure between transfer belt 52 and substrate 56 at contact point 55. Wheel 62 is of a smaller diameter than wheel 60 so that transfer belt 52 does not contact substrate 56 at any pont other than contact point 55.

In operation, thermal print head 42 applies an image to transfer belt 52. Transfer roller 64 provides a suitable back-up support for print head 42. The applied image is then conveyed on transfer belt 52 around wheel 60 to contact point 55 where it is transferred to substrate 56 conveyed thereunder. The residual surface energy of substrate 56 is higher than transfer belt 52. The thermal transfer ink, having greater affinity for substrate 56 is transferred from transfer belt 52 onto substrate 56 in the desired pattern. The desired pattern forms the image applied to substrate 56.

Substrate 56 may then be conveyed in-line for further processing. In the event substrate 56 is printed with ceramic ink, substrate 56 is conveyed to a Lehr for firing and shaping.

A second color may be applied to transfer belt 52 to create a two-color print process. Here, the single color image applied to transfer belt 52 is conveyed from thermal transfer print head 42 to thermal transfer print head 44. Thermal transfer print head 44 applies a second color contained on thermal transfer ribbon 45 over the first color image thereby forming a two-color image. This process can be repeated with thermal transfer print heads 46, 48, and 50 to form a multi-color process.

Once the multicolor image is applied to substrate 56 at point 55, transfer belt 52 rotates back around wheel 62 to print head 42. A plurality of idlers, collectively 66, prevent transfer belt 62 from contacting substrate 56 in as return path. At least one idler 66 may include a cleaning station so as to remove excess ink which was not applied to substrate 56.

Figure 7:
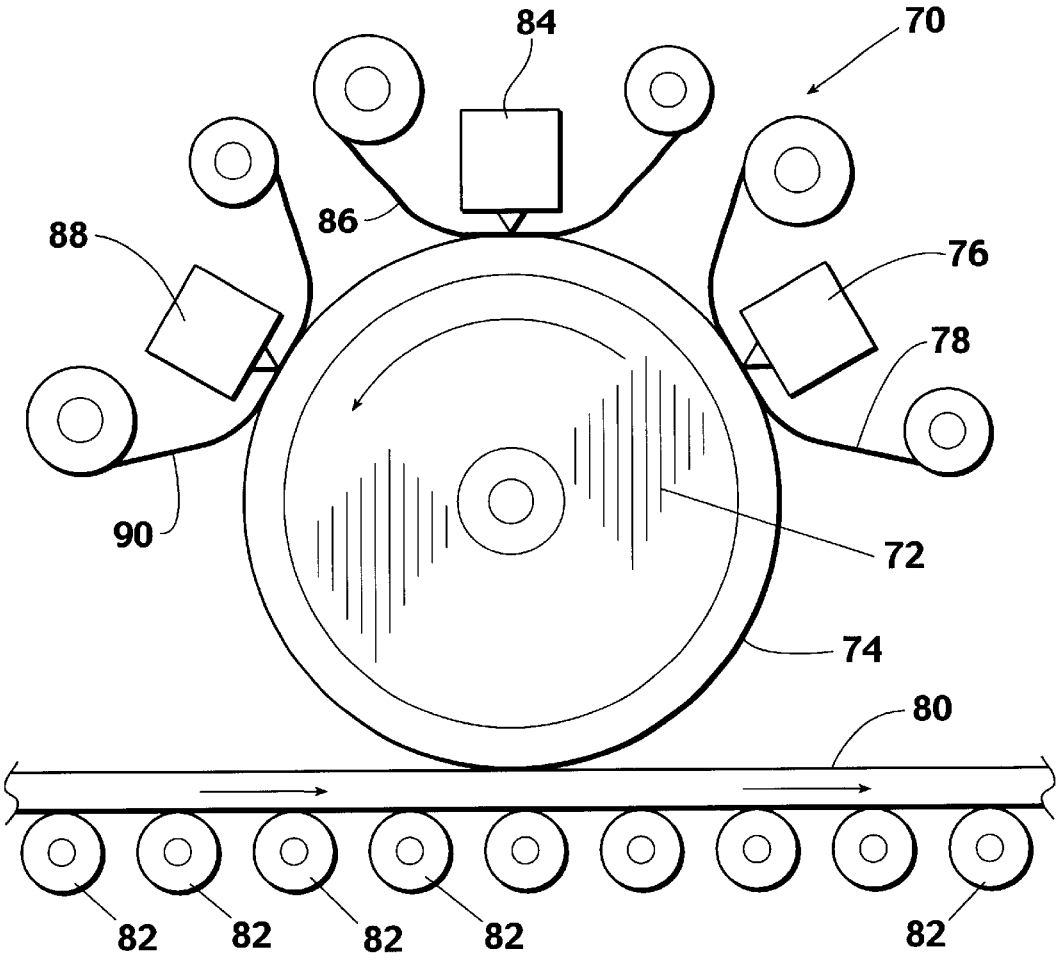
FIG. 7 is a schematic side view depicting multiple thermal digital print heads printing an image onto a cylindrical transfer member which is then imparting the image onto a flat rigid substrate conveyed thereunder.

FIG. 7 depicts an indirect thermal transfer printing process 70 wherein the transfer member is a cylinder or drum 72. Drum 72 includes a transfer surface 74 capable of receiving and releasing an image from thermal transfer print head 76 to substrate 80. Transfer surface 74 is of a silicone, fluorine or elastomeric construction as described above.

Thermal print head 76 applies an image to drum 72 by selectively heating a meltable type thermal transfer ribbon 78 which transfers the ink from ribbon 78 onto drum 72. Drum 72 is rotated as shown so as to carry the image into contact with substrate 80. Substrate 80 is conveyed under drum 72 by any known means such as a vacuum belt or rollers 82. The residual surface energy of substrate 80 is higher than drum 72 so that the image contained on drum 72 is released by drum 72 onto substrate 80. Print head 76 and drum 72 may be of any width required by the application including the width of substrate 80.

Substrate 80 may then be conveyed in-line for further processing. In the event substrate 80 is printed with ceramic ink, such as for automotive or appliance glass or ceramic tile, substrate 80 is conveyed to a Lehr for further firing and shaping. The flat, rigid substrate 80 of FIG. 7 could be replaced with a three dimensional article, such as a ceramic cup or other such ceramic article, hollow-ware, or other objects having non-planar surfaces.

A second color may be applied to drum 72 to create a two-color print process. Here, drum 72 is rotated positioning the single color image applied to drum 72 by print head 76 underneath print head 84. Thermal transfer print head 84 applies a second color contained on thermal transfer ribbon 86 over the first color image thereby forming a two-color process. This process can be repeated with thermal transfer print head 88 to form a multi-color process. Additional thermal transfer print heads could be configured for additional colors as required. The process of FIG. 7 is designed to be a continuous process. A cleaning station could be added to remove excess ink from drum 72 as a point on its circumference rotates past contact with substrate 80.

The transfer member of the present process could alternately be a decal substrate upon which the image is printed using the thermal transfer print process of the present invention. Such decal substrates include natural papers, synthetic papers, membranes, films, and polymers known in the industry for this purpose. Examples of such decals include heat release decals, pressure release decals, and water-slide decals. When a ceramic ink is employed in the present process a heat release ceramic decal is formed wherein the organic constituents in the decal substrate burn off during firing while the pigment and frit fuse with the substrate.

In addition, the transfer method described with regard to FIGS. 6 and 7 could print from the transfer member as described therein to a decal substrate. The resultant decal may be applied directly to a rigid or three dimensional substrate, stored for later use, or transported to a different location for application.

While the invention has been described with a certain degree of particularity, it is manifest that many changes may be made in the details of construction without departing from the spirit and scope of this disclosure. It is understood that the invention is not limited to the embodiment set forth herein for purposes of exemplification, but is to be limited only by the scope of the attached claim or claims, including the full range of equivalency to which each element thereof is entitled.

What is claimed is:

1. A process for affixing an image comprising the steps of:

a) obtaining a digital representation of said image;

b) providing a substrate capable of receiving the image;

c) applying the image to said substrate in a pattern by a digital thermal transfer printer with a ceramic ink whereby the image substantially conforming to said pattern supplied by said digital thermal transfer printer is affixed to said substrate;

d) firing out said substrate.

2. The process of claim 1 wherein said substrate is a rigid three dimensional object.

3. The process of claim 1 including the intermediate steps of:

applying the image to a transfer member;

transferring the image from said transfer member to said substrate.

4. The process of claim 3 wherein said transfer member includes an elastomeric compound as a release agent.

5. The process of claim 4 wherein the release agent is a compound selected from a group consisting of a silicone group containing resin, a silicone group containing rubber, a fluorine containing resin, and a fluorine containing rubber.

6. The process of claim 5 wherein said decal substrate is a material selected from a group consisting of natural papers, synthetic papers, membranes, films, and polymers.

7. The process of claim 3 wherein said transfer member is a decal substrate.

8. The process of claim 1 wherein said ceramic ink includes a frit and particles of a group consisting of pigments, dyes, toners, colorant oxides, metallic powders, refractories, stains, clear coatings, conductives and/or micaceous powders dispersed in a binding medium.

9. The process of claim 8 wherein the binding medium is a compound or mixture selected from a group consisting of wax, resin, oil, solvent, polymers, radiation curable, water miscible, and thermoplastic.

10. A process for affixing an image to a three dimensional substrate comprising the steps of:

a) providing a transfer member capable of receiving and transferring the image;

b) providing a digital thermal transfer printer including a foil or ribbon having ceramic ink thereon;

c) applying the image to the transfer member in a pattern by a digital thermal transfer printing process a ceramic ink whereby the image substantially conforming to said pattern supplied by said digital thermal transfer printer is affixed to said transfer member;

d) transferring the image from said transfer member to said three dimensional substrate;

e) firing out said substrate.

11. The process of claim 10 wherein said ceramic ink is a composition including frit and particles of a group consisting of pigments, dyes, colorant oxides, metallic powders, conductives, refractories, stains and/or micaceous powders dispersed in a binding medium.

12. The process of claim 11 wherein the binding medium is a compound or mixture selected from a group consisting of wax, resin, oil, solvent, polymers, radiation curable, water miscible, and thermoplastic.

13. The process of claim 11 wherein the release agent is a compound selected from a group consisting of a silicone group containing resin, a silicone group containing rubber, a fluorine containing resin, and a fluorine containing rubber.

14. The process of claim 10 wherein the digital thermal transfer printer is a fixed array printer.

15. The process of claim 10 wherein the digital thermal transfer printer is an x, y, z plotter printer.

16. The process of claim 10 wherein the digital thermal transfer printer is an articulated arm printer.

17. A process for affixing an image to a three dimensional substrate comprising the steps of:

a) providing a transfer member capable of receiving and releasing the image;

b) applying the image to the transfer member in a pattern by a digital thermal transfer printing process an ink composition whereby the image substantially conforming to said pattern supplied by said digital thermal transfer printer is affixed to said transfer member;

c) transferring said decorative image from said transfer member to said three dimensional substrate.

18. The process of claim 17 wherein the transfer member is a compound selected from a group consisting of a silicone group containing resin, a silicone group containing rubber, a fluorine containing resin, and a fluorine containing rubber.

19. The process of claim 17 wherein said ink composition is a ceramic ink composition.

20. The process of claim 19 wherein said transfer member is a decal.

21. The process of claim 19 wherein said ceramic ink composition includes frit and particles of a group consisting of pigments, dyes, colorant oxides, metallic powders, refractories, conductives, stains, and/or micaceous powders dispersed in a binding medium.

22. The process of claim 21 wherein said binding medium is a compound selected from a group consisting of wax, resin, oil, solvent, water miscible, radiation curable and thermoplastic.

23. The process of claim 19 wherein said three dimensional substrate including said decorative image thereon is dried, cured, oxidized or bonded.

24. The process of claim 17 wherein the digital thermal transfer printer is a fixed array printer.

25. The process of claim 17 wherein the digital thermal transfer printer is an x, y, z plotter printer.

26. The process of claim 17 wherein the digital thermal transfer printer is an articulated arm printer.

* * * * *